US007798356B2

(12) United States Patent
Kobayashi et al.

(10) Patent No.: US 7,798,356 B2
(45) Date of Patent: Sep. 21, 2010

(54) TUBULAR CASE

(75) Inventors: Shogo Kobayashi, Osaka (JP); Hideto Shima, Kyoto (JP)

(73) Assignee: Kokuyo S&T Co., Ltd, Osaka (JP)

( * ) Notice: Subject to any disclaimer, the term of this patent is extended or adjusted under 35 U.S.C. 154(b) by 656 days.

(21) Appl. No.: 11/679,745

(22) Filed: Feb. 27, 2007

(65) Prior Publication Data

US 2007/0221671 A1 Sep. 27, 2007

(30) Foreign Application Priority Data

Mar. 27, 2006 (JP) ..... 2006-085442

(51) Int. Cl.
*B65D 43/26* (2006.01)
*B65D 17/52* (2006.01)

(52) U.S. Cl. ..... 220/285; 215/304; 215/305

(58) Field of Classification Search ..... 215/304, 215/305, 295, 303; 220/285, 760, 284, 286
See application file for complete search history.

(56) References Cited

U.S. PATENT DOCUMENTS

| | | | | |
|---|---|---|---|---|
| 545,171 | A * | 8/1895 | Purple | 215/284 |
| 708,293 | A | 9/1902 | Baker | |
| 1,074,539 | A | 9/1913 | Baker | |
| 1,552,134 | A | 9/1925 | Frey | |
| 1,803,225 | A * | 4/1931 | Wiener | 215/296 |
| 1,982,124 | A * | 11/1934 | Smith | 220/756 |
| 2,311,719 | A * | 2/1943 | White | 215/304 |
| 2,999,714 | A * | 9/1961 | Ritchie | 294/31.2 |
| 3,638,823 | A * | 2/1972 | McCoy | 215/399 |
| 5,445,425 | A * | 8/1995 | Lyver | 294/31.2 |

FOREIGN PATENT DOCUMENTS

| | | |
|---|---|---|
| GB | 325532 | 2/1930 |
| JP | 08-258495 | 10/1996 |
| JP | 08258495 A | 10/1996 |
| JP | 2005-271942 A | 10/2005 |
| JP | 2005271942 | 10/2005 |

OTHER PUBLICATIONS

European Patent Office Search Report mailed Jul. 27, 2007 and English Translation.

* cited by examiner

*Primary Examiner*—Nathan J Newhouse
*Assistant Examiner*—James N Smalley
(74) *Attorney, Agent, or Firm*—Lowe Hauptman Ham & Berner

(57) ABSTRACT

A cylindrical case receives a stick in a reciprocating manner so through an opening of the case. A cap is arranged to engage with the opening of the case. Engagement release of the cap is carried out by rotating an operating member. The operating member includes a peripheral member and an operating force imparting portion continuous with the peripheral member mounted on an upper portion of the case. When the operating force imparting portion is pressed downward, force apply points opposite to the operating force imparting portion impart a push-up force to the cap thereby releasing the cap from the engagement with the case.

5 Claims, 9 Drawing Sheets

TUBULAR CASE

RELATED APPLICATIONS

The present application is based on, and claims priority from, Japanese Application Ser. No. 2006-085442, filed Mar. 27, 2006, the disclosure of which is hereby incorporated by reference herein in its entirety.

FIELD OF THE INVENTION

The present invention relates to a tubular case arranged to receive, for example, a stick of solid glue as an item to be received in a reciprocating manner so as to come out and retract through an opening of the case, more particularly to a tubular case a cap of which can be easily detached from the case.

BACKGROUND OF THE ART

Conventionally, there is known a tubular case having a substantially cylindrical shape in appearance, which is arranged to receive a stick of solid glue as an item to be received in a reciprocating manner so as to come out and retract through an opening formed at one end of the case. The tubular case includes a cap covering the opening of the case. The cap is arranged to engage with the periphery of the case with a snap.

A cap of this type can be prevented from accidental falling-off from the case owing to the above arrangement of engagement. However, since the cap has a relatively short cylindrical shape with respect to the length of the entire tubular case, the cap has a disadvantage such that fingers are slippery while releasing the cap from the engagement which causes a burdensome operation to detach the cap.

To solve the above problem, there has been proposed a tubular case arranged to release an engagement between a case and a cap so that the cap can be easily detached from the case (for example, refer to Patent document 1). According to the patent document 1, such an arrangement is adopted that the tubular case is provided with a supporting rod, which has a substantially U-like shape having its rotation center in radial direction of a cylindrical case with substantially 1800 intervals away from each other, and when the supporting rod is rotated, a cam formed at open side of the U-shape is brought into contact with a lower end of peripheral wall of the cap. And when the cap is displaced at a predetermined angle with respect to an axial direction of the case, the engagement is released.

[Patent document 1] Japanese Patent Application Laid-Open No. HEI 8-258495

SUMMARY OF THE INVENTION

Problem to be Solved by the Invention

However, the arrangement disclosed in the patent document 1 has the following disadvantages. That is, since the supporting rod has a substantially U-like shape and the distance between the cam and the rotation center is extremely small, in other words, a force apply point imparting a force for releasing the cap from the engagement is extremely close to a fulcrum, it is difficult to reduce the operating force required for releasing the cap from the engagement and also a large displacement of the cap can not be ensured. To reduce the operating force, it is required to enlarge the distance between the rotation center corresponding to the fulcrum and a working point where the operating force is imparted. Consequently, the following disadvantages are resulted in. That is, the working point side of the supporting rod has to be largely projected in the radial direction of the case. Moreover, there is such a disadvantage that the cap may be accidentally released from the engagement as the working point side projects largely as described above.

Object of the Invention

The present invention has been proposed in view of the above disadvantages. It is an object of the invention to provide a tubular case, in which a cap engaged with the case can be released from engagement with a small operating force, and protruding amount of operating force imparting portion can be restrained.

Another object of the present invention is to provide a tubular case capable of prohibiting operation of an operating member to prevent accidental detachment of the cap.

Means for Solving Problems

To achieve the object, the present invention adopts the following arrangement; i.e., a tubular case, which includes:

a case having a substantially cylindrical shape one end of which is opened to receive an item to be received in a reciprocating manner so as to come out and retract through the opening;

a cap engaged with an open side of the case to cover the opening; and an operating member mounted on the periphery of the case and arranged to release the cap from engagement, wherein the operating member includes a peripheral member, which is rotatably supported at two points on an imaginary straight line crossing an axial direction of the case as a rotation center, and an operating force imparting portion formed continuously with the peripheral member, the peripheral member has a shape that substantially encloses the periphery of the case and includes force apply points for imparting a force in a direction where the cap is released from the engagement, the force apply points are located at symmetrical positions away from the rotation Center at the opposite side to the operating force imparting portion.

The present invention preferably employs an arrangement that the peripheral member is formed in a closed loop shape enclosing the peripheral surface of the case.

The cap is formed in a shape having an open end and includes a top wall and a peripheral wall continuous with the periphery of the top wall, the tubular case may be arranged so that, when an operating force is imparted to the operating force imparting portion and the peripheral member is rotated and displaced, the force apply points only are brought into contact with end portions at the open end side of the peripheral wall thereby releasing the cap from the engagement.

Further, the opposite side of the operating force imparting portion in the peripheral member is provided with a non-contact area which maintains the contact only at the force apply points.

The peripheral member may also have a substantially C-like shape in plane view and the force apply points may be formed at open ends of the C-like shape.

In addition, the case is preferably formed with protruded portions providing a rotation center for moving the cap in a direction to release the engagement.

A stopper mechanism for prohibiting the operation of the operating member may be provided between the case and the peripheral member.

Effect of the Invention

According to the present invention, the peripheral member has a shape that substantially encloses the periphery of the case and the force apply points are located at the symmetrical points distanced away from the rotation center. Accordingly, a force for imparting an operating force to the operating member to release the engagement of the cap can be reduced, and a force for moving the cap in a direction of release from the engagement can be evenly dispersed. When the peripheral member constituting the operating member has a closed loop shape, the force apply points can be located as far as possible away from the rotation center to minimize the operating force. Moreover, the operating force imparting portion is not required to be protruded largely from the peripheral member. Accordingly, the operating member can be designed integrally with the tubular case in appearance thereby decreasing such a case that the unexpected operating force is applied thereon.

Also, such an arrangement is adopted that, when the peripheral member is rotated and displaced, the force apply points only come into contact with the end portions at the open side of the cap peripheral wall. That is, since the portion between the force apply points is kept in a non-contact state, a large rotation angle can be ensured for the operating member, and thus the cap can be detached from the case with a force small enough to pick up the same.

In an arrangement that the peripheral member is formed in a substantially C-like shape in plane view and the force apply points are formed at the open side of the C-like shape, the operating member can be easily mounted onto the case. Compared to the case of U-like shape in plane view, the force apply points can be located relatively far away from the rotation center, thus such a disadvantage is not brought about that large operating force is required.

Further, in an arrangement that a rotation center forming portions for forming the rotation center of the cap is arranged in the case, the cap can be released from the engagement with a stable rotation of the cap.

Furthermore, in an arrangement that a stopper mechanism is provided between the case and the peripheral member, the operating member is prevented from being accidentally rotated, thereby ensuring the cap being reliably attached on the case.

EXPLANATION OF REFERENCE NUMERALS

Figure 1:
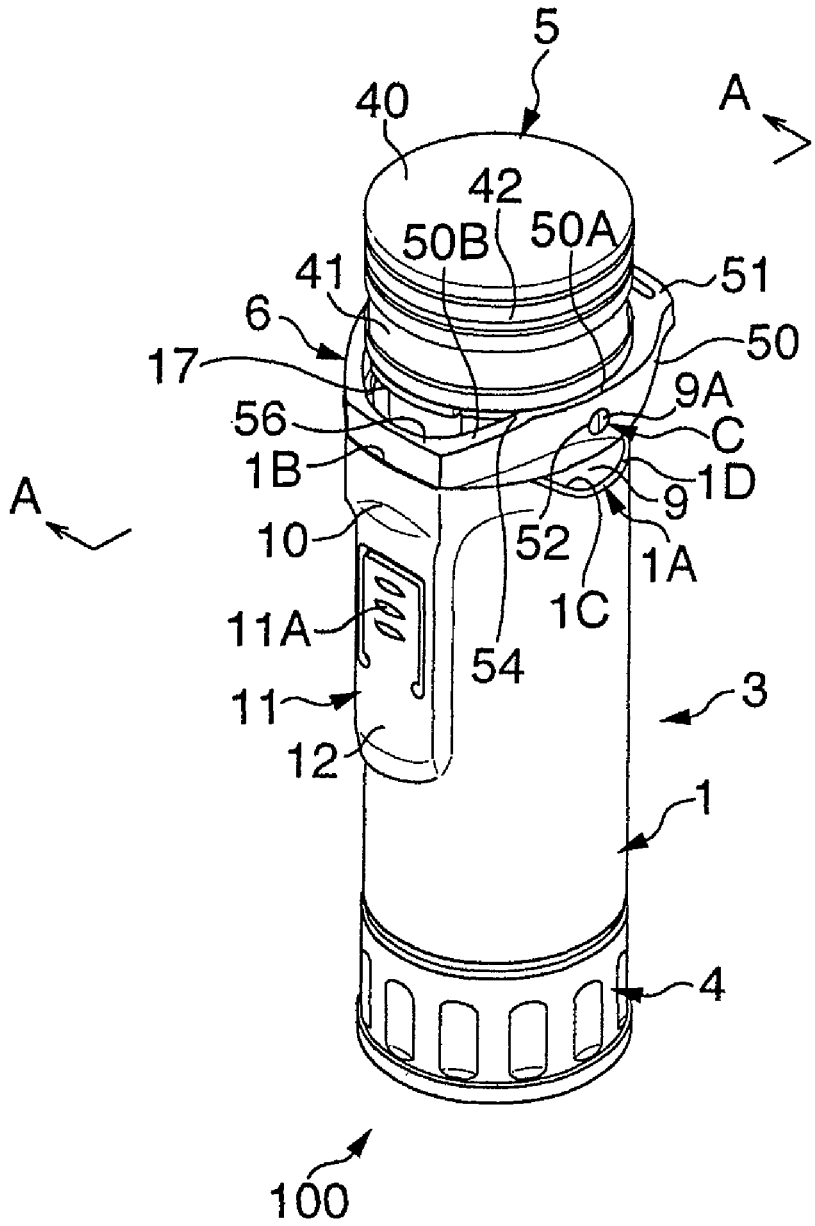
FIG. 1 is a schematic perspective view showing an entire arrangement of a tubular case according to an embodiment of the present invention.

1 . . . case body
2 . . . cartridge
3 . . . case
5 . . . cap
6 . . . operating member
8 . . . solid glue (item to be received)
17 . . . rib (protruded portion)
40 . . . top wall
41 . . . peripheral wall
50 . . . peripheral member
51 . . . operating force imparting portion
54 . . . force apply point
56 . . . non-contact area
60 . . . stopper mechanism
100 . . . tubular case
C . . . rotation center

DESCRIPTION OF THE PREFERRED EMBODIMENTS

Now, referring to the attached drawings, a description will be given as to an embodiment in which the present invention is applied to a tubular case arranged to receive a stick of solid glue as an item to be received.

Figure 2:
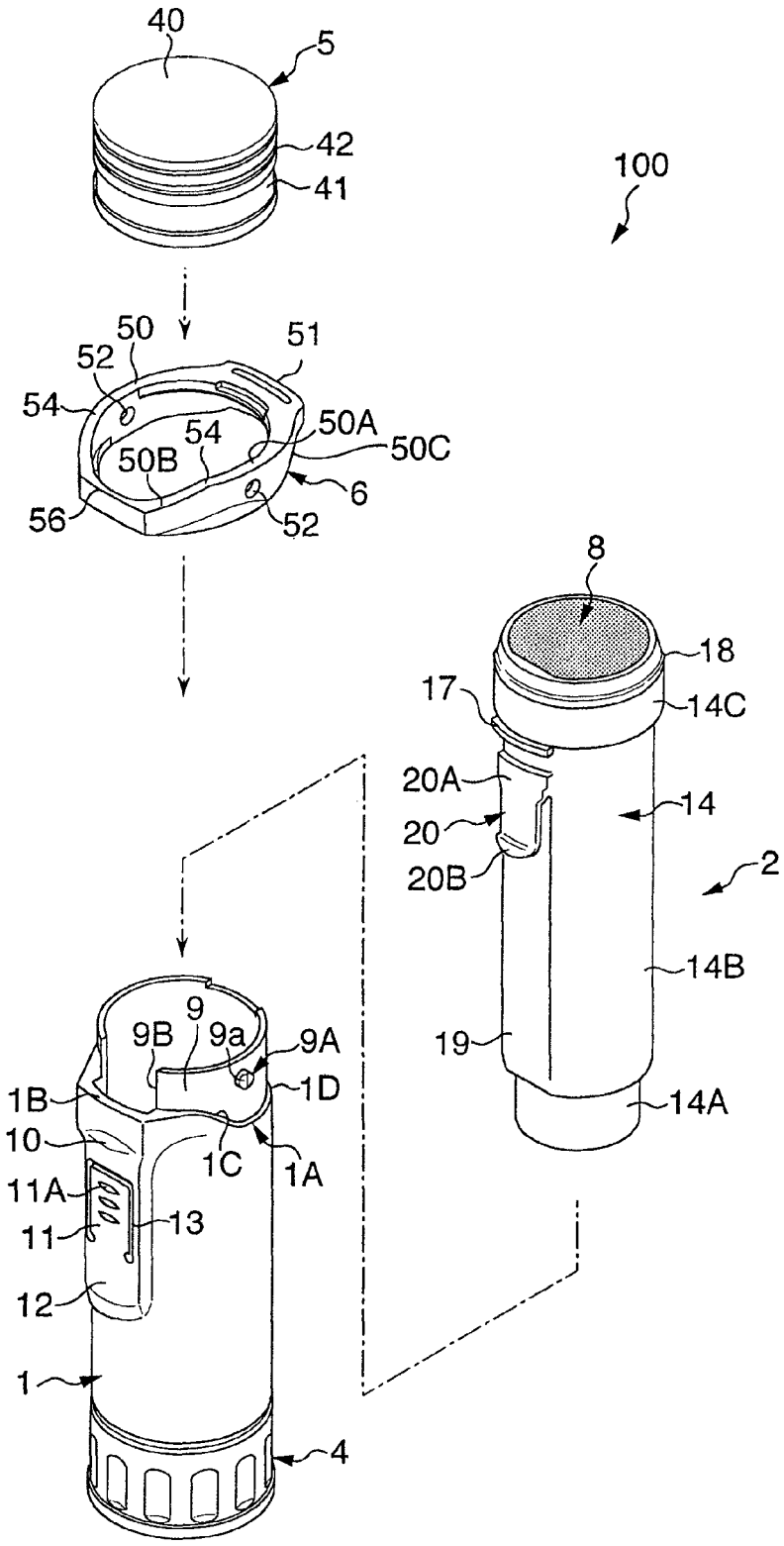
FIG. 2 is a partially exploded perspective view of the tubular case in FIG. 1.
Figure 3:
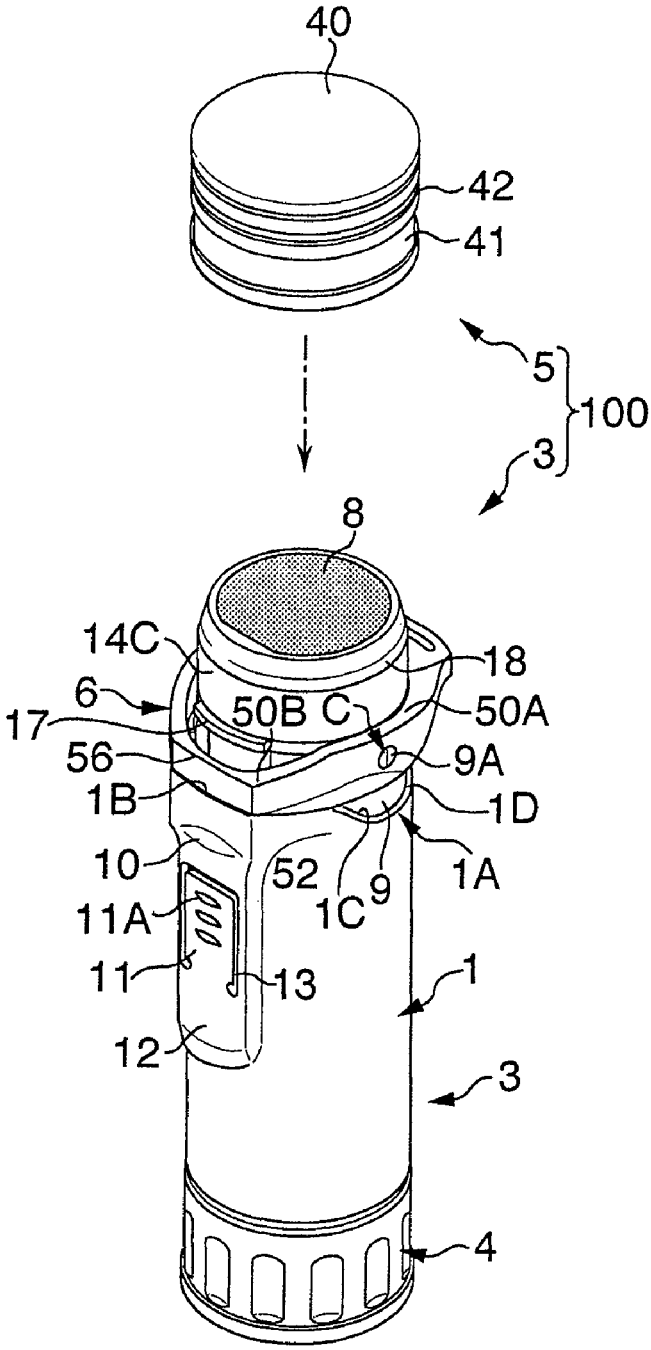
FIG. 3 is a schematic perspective view showing the tubular case of FIG. 1, from which a cap is detached.

FIG. 1 is a schematic perspective view of a tubular case according to an embodiment of the present invention, and FIG. 2 is an exploded perspective view thereof. FIG. 3 is a schematic perspective view of the tubular case from which a cap is detached. Referring to these figures, a tubular case 100 comprises a case body 1, a case 3 including a cartridge 2, which is received in the case body 1 (refer to FIG. 2), an operating knob 4 rotatably attached to a lower end portion of the case body 1 in figures, a cap 5, engaging with an upper end portion of the cartridge 2 in figures, and an operating member 6 for releasing the engagement between the cap 5 and the cartridge 2.

As shown in FIG. 2, the external diameter in a specified area of the upper end of the case body 1 along an axial direction (vertical direction) is formed slightly smaller than that of the other area, which is to be as a mounting area 9 for the operating member 6. In the mounting area 9, protruding shafts 9A and 9A forming rotation centers of operating members 6 are provided at two points substantially 1800 intervals away from each other in a circumferential direction thereof on an imaginary straight line crossing the axial direction of the case 3. Each of the protruding shafts 9A and 9A has a partially inclined face 9*a* in the tip portion thereof with respect to a shaft line of the protruding shaft 9A. When the operating member 6 is positioned around the mounting area 9 to be rotated in a plane, the inclined face 9*a* helps the operating member 6 to be easily engaged through a bearing hole, which is to be described later. In the upper side of the case body 1, a holding portion 10 for holding the cartridge 2 and a press portion 11 for releasing the cartridge 2 from the hold are formed in an area immediately below a cut-off portion 9B formed in the mounting area 9. A lower end (boundary) of the mounting area 9 including a portion formed with the protruding shafts 9A is formed as a step 1A. The step 1A includes an upper step portion 1B as the upper end of the holding portion 10, an inclined step portion 1C continuous with the upper step portion 1B and lower step portion 1D continuous with the inclined step portion 1C. The lower portion on the force apply point side of the operating member 6 is arranged so as to abut on the upper step portion 1B when the operating member 6 is not in operation, and on the other hand when the operating member 6 is in operation, a side of operating force imparting portion of the operating member 6 (which will be described later) is arranged so as to come into contact with the lower step portion 1D to regulate the rotating position of the operating member 6.

Figure 4:
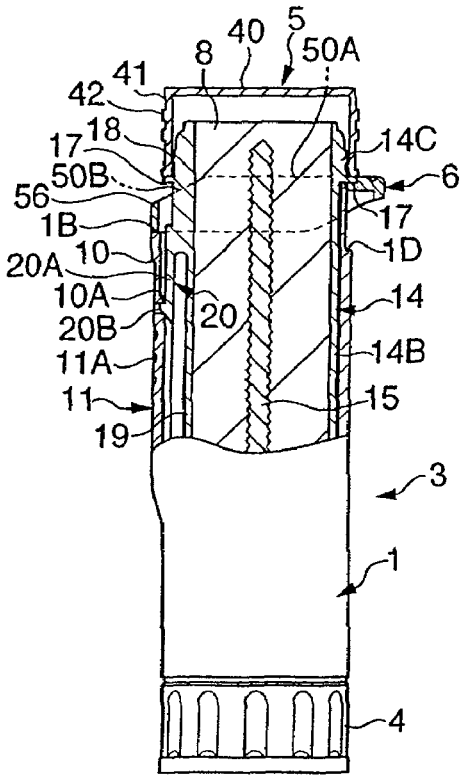
FIG. 4 is a sectional view of the tubular case taken along the line A-A in FIG. 1.

The holding portion 10 and the press portion 11 are formed in a raised area 12 where the outer surface of the case body 1 is slightly shifted outward. In the raised area 12, a slit 13 is formed in an inversed substantially U-like shape thereby forming the press portion 11 inside area of the slit 13. An upper area of the slit 13 is formed as the holding portion 10. The holding portion 10 is provided in a shape having an inside catch 10A formed at the lower end of an internal surface side thereof as shown in FIG. 4. The press portion 11 has a shape having an anti-slip grooves 11A formed on an outer surface side thereof. The press portion 11 has elasticity so as to elastically deform inward and outward with respect to the case body 1. When a press force is given inward to the anti-slip portion 11A with a finger, the anti-slip portion 11A is elastically deformed inward and a piece to be held (which will be described later) is displaced inward. When the press force is released, the anti-slip portion 11A returns to the initial position.

Figure 5:
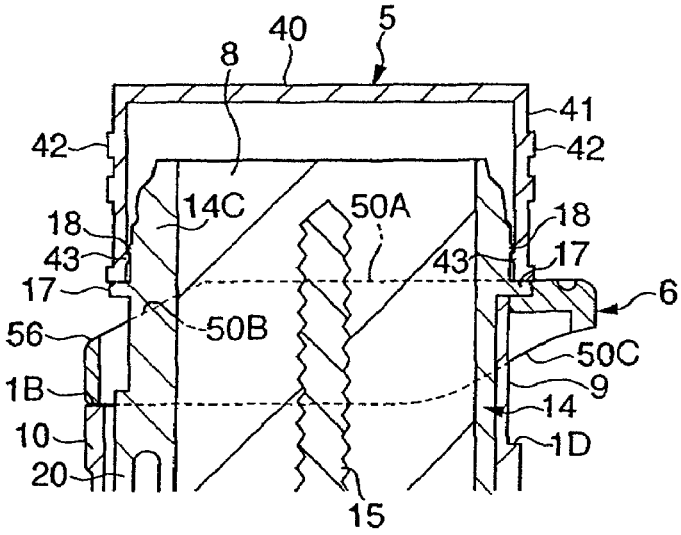
FIG. 5 is a partially enlarged sectional view of the tubular case in FIG. 4.

As shown in FIG. 2, the cartridge 2 includes an inner cylinder 14 located inside the case body 1, a shaft member 15 rotatably supported inside the inner cylinder 14 (refer to FIGS. 4 and 5) and a receiving member having a plate-like shape (not shown), which is screwed with the shaft member 15 so as to support the lower end of the solid glue 8. The inner cylinder 14 includes a lower peripheral wall 14A, an intermediate peripheral wall 14B and an upper peripheral wall 14C. The intermediate peripheral wall 14B has a larger diameter than that of the lower peripheral wall 14A and is continuous with the upper portion thereof. The upper peripheral wall 14C has a larger diameter than that of the intermediate peripheral wall 14B and is continuous with the upper end of the intermediate peripheral wall 14B and located above the upper end of the case body 1. The upper peripheral wall 14C is a portion forming an opening for allowing the solid glue 8 to come out and retract therethrough. As shown in FIGS. 4 and 5, a rib 17 as a projected portion and a protruding portion 18 are formed on the outer peripheral surface of the upper peripheral wall 14C, the rib 17 regulating engagement depth of the cap 5 and functioning as a rotation center of the cap when the cap is moved by the operating member 6 in a direction where the cap is released from the engagement. The protruding portion 18 is formed around the periphery of the upper peripheral wall 14C above the rib 17. The intermediate peripheral wall 14B includes a flat portion 19 having a substantially flat surface extending in a vertical direction in a partial area along the circumferential direction. In an upper portion of the flat portion 19, a piece to be held 20 is provided, which is held by the holding portion 10. The piece to be held 20 includes a vertical face portion 20A which extends downward forming a space between the flat portion 19 and the piece to be held 20 and an outer peripheral catch 20B which is formed on the outer surface of the vertical face portion 20A at the lower end thereof. When the cartridge 2 is inserted into the case body 1, the outer peripheral catch 20B is engaged with a lower surface of the inside catch 10A of the holding portion 10 thereby preventing the cartridge 2 from being pulled out from the case body 1. In this state, the vertical face portion 20A is received within the raised area 12, and thus the cartridge 2 is prevented from rotating in its circumferential direction while the cartridge 2 is received inside the case body 1. Note that, by pressing the press portion 11 to displace the lower end of the vertical face portion 20A inward, the engagement is released, thus the cartridge 2 can be pulled out from the case body 1.

The shaft member 15 is provided with a gear at the lower end thereof for transmitting rotation of the operating knob 4 to the shaft member 15 along the circumferential direction thereof (detailed structure is not shown in the figures). The receiving member (not shown) screwed with the shaft member 15 is supported within the inner cylinder 14 so as to move in a direction along the shaft member 15 without rotating. Owing to this arrangement, the solid glue 8 is supported by the receiving member (not shown) in a reciprocating manner so as to come out and retract through the upper opening of the inner cylinder 14. It should be noted that the arrangement of the case body 1 and the cartridge 2 is substantially identical to an arrangement previously disclosed by the Applicant of the present invention in Japanese Patent Application Laid-Open No. 2005-271942. Therefore, further detailed description of the arrangement is omitted.

The cap 5 includes a top wall 40 and a peripheral wall 41 continuous with the periphery of the top wall 40 and one end thereof, i.e., the lower end in the figures is opened. A plurality of projections 42 for preventing slippage are formed circularly extending outward around the periphery of the peripheral wall 41. Inner side of the peripheral wall 41 is formed a circular projection 43, which overrides downward the protruding portion 18 formed on the periphery of the upper peripheral wall 14C constituting a part of the inner cylinder 14 (refer to FIG. 5). The cap 5 is dimensionally designed so that, when the circular projection 43 overrides downward the protruding portion 18 and engages therewith, the lower end of the peripheral wall 41 abuts on the rib 17, 17.

Figure 6:
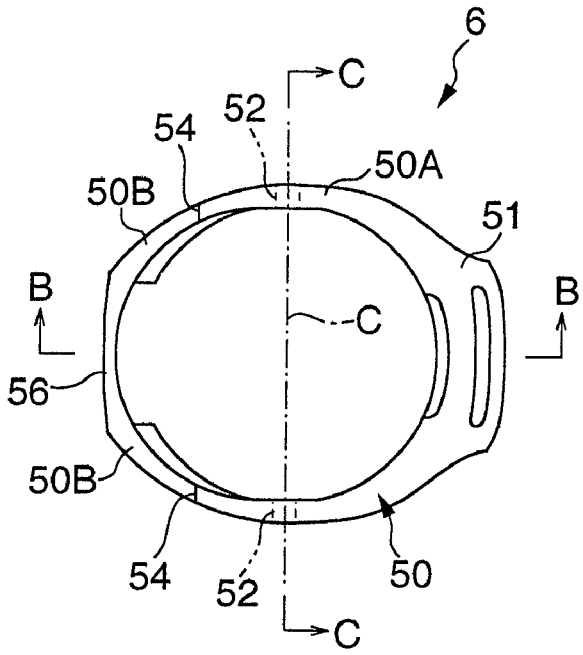
FIG. 6 is a plan view of an operating member.
Figure 7:
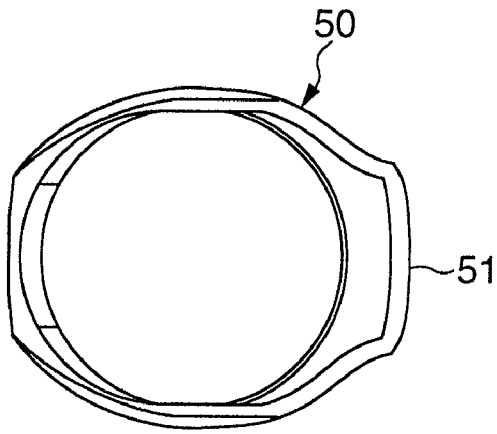
FIG. 7 is a bottom plan view of the operating member.
Figure 8:
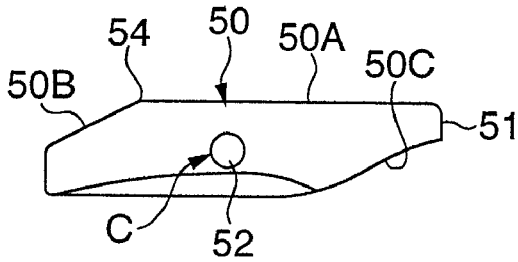
FIG. 8A is a front view of the operating member.
FIG. 8B is a cross-sectional view taken along the line B-B in FIG. 6.
FIG. 8C is a left side view of the operating member in FIG. 8A.
FIG. 8D is a cross-sectional view of the operating member taken along the line C-C in FIG. 6.
Figure 8:
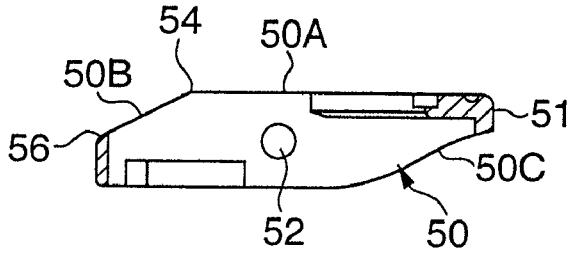
Figure 8:
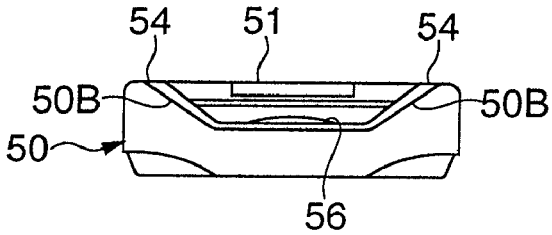
Figure 8:
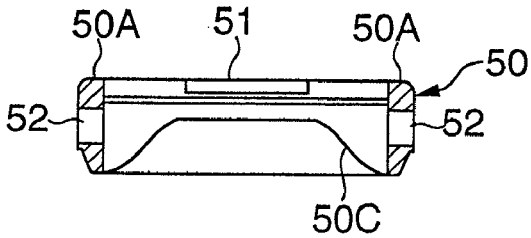

As shown in FIGS. 6 to 8, the operating member 6 includes a peripheral member 50 having a closed loop shape in plane view so as to enclose the upper peripheral wall 14C and an operating force imparting portion 51 continuous with the peripheral member 50. The peripheral member 50 is formed with bearing holes 52 for receiving the protruding shafts 9A, which are formed on the case body 1, with 180° intervals away from each other in the circumferential direction thereof The protruding shafts 9A and the bearing holes 52 are arranged to form a rotation center C of the operating member 6. The peripheral member 50 includes an upper flat face portion 50A and inclined face portions 50B continuous with the upper flat face portion 50A and located at opposite sides to the operating force imparting portion 51 as shown in FIG. 8(A). Boundary portions between the upper flat face portion 50A and the inclined face portions 50B are formed as force apply points 54 and 54 that impart a force in a direction where the cap 5 is released from the engagement. The force apply points 54 are formed at symmetrical points away from the rotation center C as shown in FIG. 8. An upper face between the force apply points 54 and 54 is formed in a concave shape in side view as shown in FIG. 8(C), which serves as a non-contact area 56 when the cap 5 is released from the engagement. Owing to this arrangement, when an operating force is given to the operating force imparting portion 51 and the peripheral member 50 is displaced with rotation, only the force apply points 54 and 54 come into contact with lower end portions of the peripheral wall 41 at the open end of the cap 5, and thereby releasing the cap 5 from the engagement. In the peripheral member 50, the lower face of the operating force imparting portion 51 has a gradually curved face 50C such that the height dimension thereof toward the operating force imparting portion 51 side becomes gradually smaller. The curved face 50C is arranged so as to come into contact with the lower step portion 1D formed in the upper portion of the case body 1 and to function as a rotation limit of the operating member 6 when the operating member 6 is rotated. Owing to the curved face 50C, the case body 1 is not required to be formed with a cut-off or concave portion for ensuring a movement space for the operating force imparting portion 51.

Now, referring to FIG. 9, detaching steps of the cap 5 according to the embodiment will be described.

Figure 9:
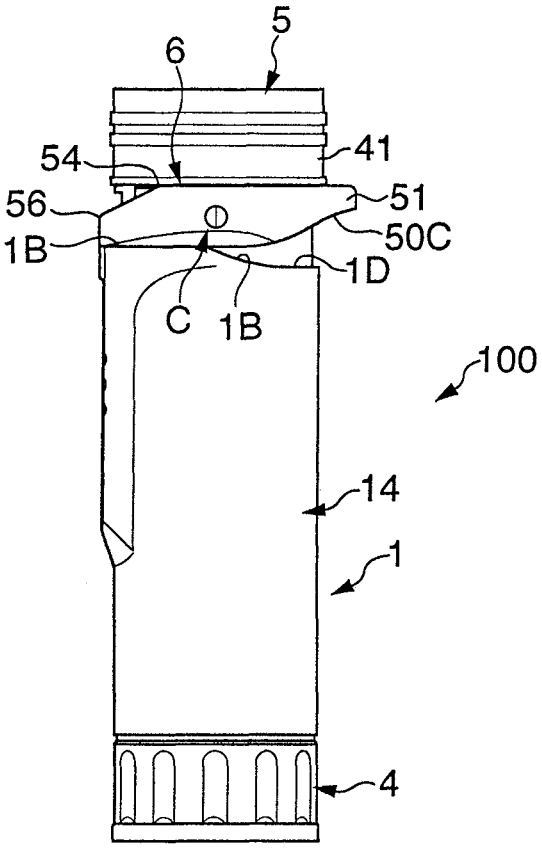
FIGS. 9A and 9B are explanatory views illustrating the working of the embodiment.
Figure 9:
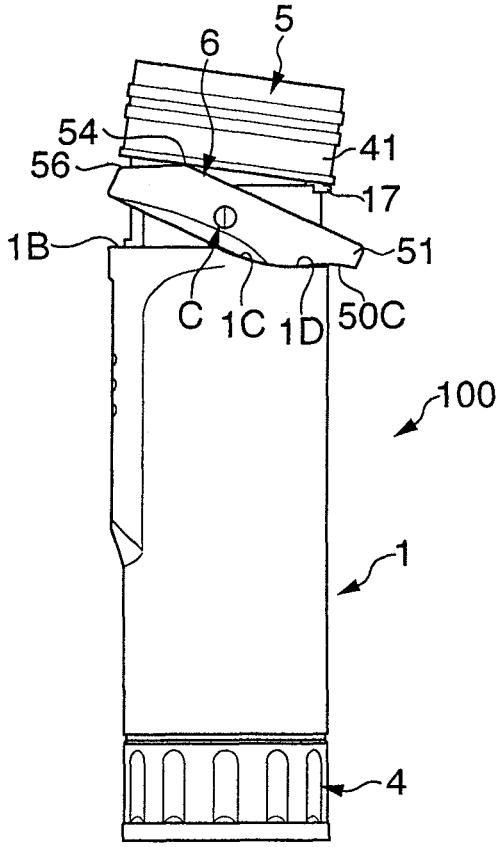

When the cap 5 is attached to the case body 1, the circular projection 43 formed on the inner surface of the peripheral wall 41 of the cap 5 is engaged with the protruding portion 18 formed in an upper area of the inner cylinder 14 (refer to FIG. 4 and FIG. 9(A)). To detach the cap 5 from this state, a finger tip is placed on the upper face of the operating force imparting portion 51 of the operating member 6 and a force is given downward. Thereby, the operating member 6 receives a force to rotate the same in a clockwise direction in FIG. 9 with the rotation center C as a fulcrum. Contact position of the cap 5 and the operating member 6 in a state receiving the rotation force is only the force apply points 54 and the lower portions of the peripheral wall. The lower end of the peripheral wall 41 of the cap 5 at the right side in FIG. 9 is brought into contact with the rib 17 and the left side of the cap is displaced upward about the contact points as the fulcrums thereby releasing the cap 5 from the engagement. Thus, in a state that the cap 5 is released from the engagement as described above, when the cap 5 is nipped with finger tips and pulled upward, the cap is completely detached from the case body 1, and then the solid glue 8 can be used.

The best arrangement, method and an item to be received for carrying out the present invention has been disclosed so far. However, the present invention is not limited to the above.

That is, the present invention has been illustrated and described mainly about a specific embodiment. However, it is possible for those skilled in the art to add various modifications to the above-described embodiment with respect to the shape, position and/or other detailed arrangements without departing from the technical spirit and the range of the object of the present invention.

The above descriptions defining shapes, positions and the like are given as examples only for facilitating understanding the present invention but not intended to limit the present invention. Therefore, any descriptions using appellations precluding a part/all of the limitations such as the shapes and the like should be understood to be included within the present invention.

Figure 10A:
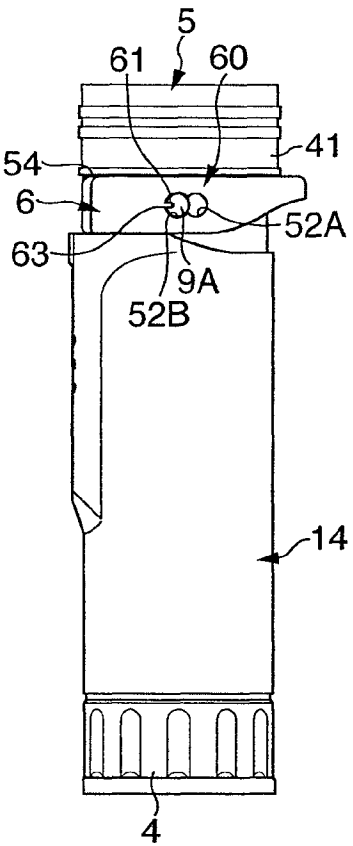
FIGS. 10A, 10B and 10C are front elevations of a tubular case of another embodiment illustrating the working thereof.
Figure 10B:
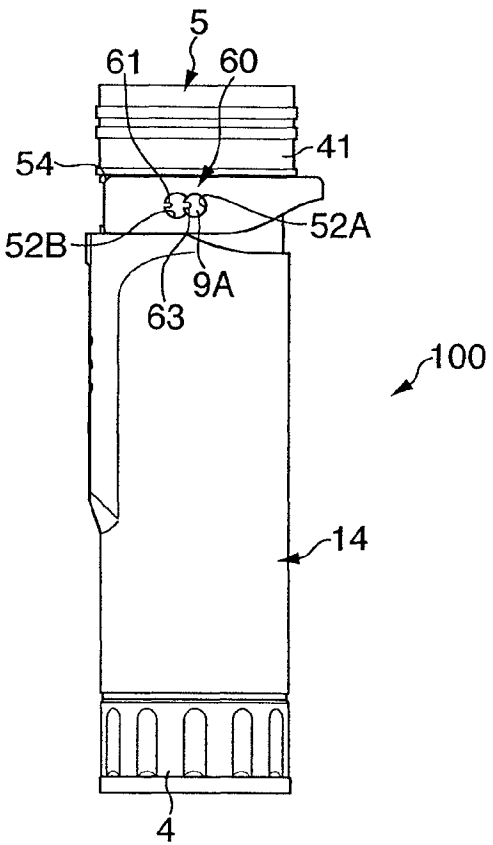
Figure 10C:
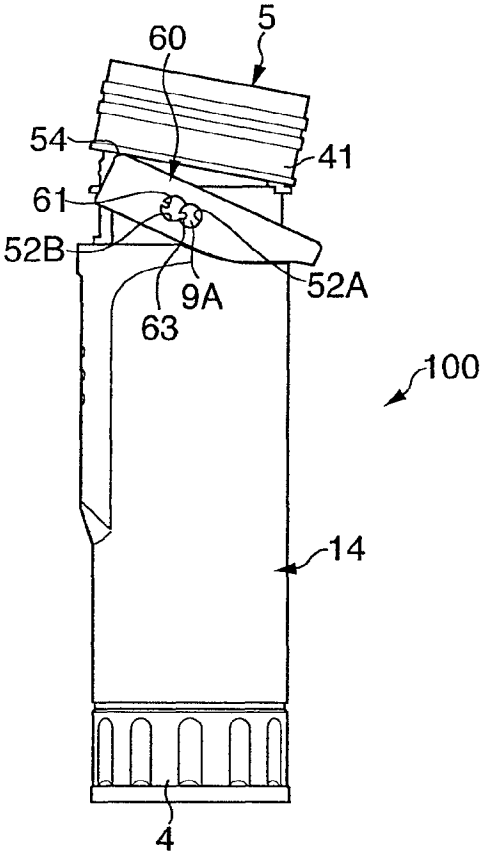
Figure 11:
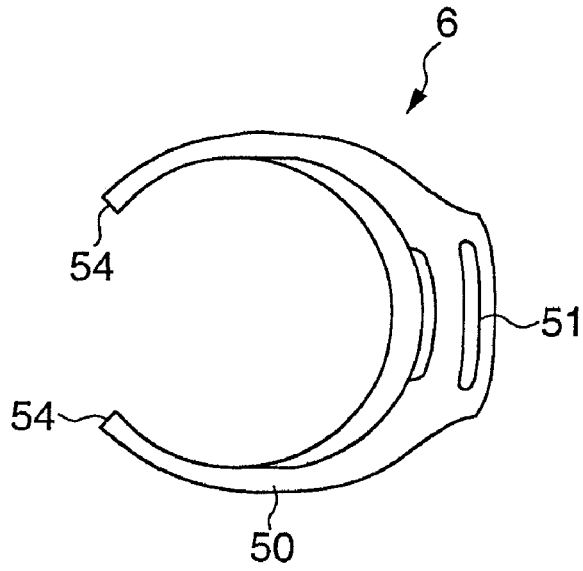
FIG. 11 is a plan view of an operating member, which is used in the another embodiment.
Figure 12:
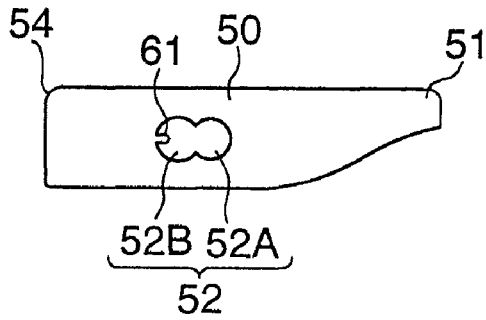
FIG. 12 is a front view of the operating member in FIG. 11.

In the above-described embodiment, there has been illustrated and described a case where the peripheral member 50 of the operating member 6 has a closed loop shape. However, for example, a modification shown in FIGS. 10 to 12 may be adopted. In the modification, a stopper mechanism 60 for prohibiting the operation of the operating member 6 is provided as shown in FIG. 10, and the peripheral member 50 is formed in a C-like shape in plane view as shown in FIGS. 11 and 12. The peripheral member 50 is characterized in that an area between the force apply points 54 and 54 is eliminated and the eliminated area is to be the non-contact area.

In the stopper mechanism 60, each of shaft holes 52 of the peripheral member 50 includes a first hole 52A and a second hole 52B continuous with the first hole 52A. A projection 61 is formed inside the second hole 52B, and a concave portion 63 is formed in a rotation shaft 9A with which the projection 61 can engage. Note that the above arrangement is provided at symmetrical positions respectively along a direction perpendicular to the drawing plane of FIG. 10, and the first and second holes constituting the bearing holes 52 are located opposite to each other in the circumferential direction. However, provision of the stopper mechanism 60 is sufficient at least on one side. The peripheral member 50 is formed in a shape that the upper end face thereof is entirely flat in a plane.

According to the above modification, when the operating member 6 is rotated at a predetermined angle in a direction of the periphery of the case body 1 as shown in FIG. 10, the projection 61 and the concave portion 63 are engaged with each other or released from the engagement. Accordingly, when the projection 61 is engaged with the concave portion 63, the operation of the operating member 6 is prohibited, and when the engagement is released, the operation of the operating member 6 is permitted, and thus the cap 5 can be detached.

Moreover, since such an arrangement is adopted that the peripheral member 50 is partially eliminated between the force apply points 54 and 54, the operating member 6 can be attached to the case body with great ease. Even when a large rotation angle is ensured for the operating member 6, the force apply points 54 always function as the portions that push up the cap 5.

What is claimed is:

1. A tubular case, comprising:

a case having a substantially cylindrical shape one end of which is opened to receive an item to be received in a reciprocating manner so as to come out and retract through the opening;

a cap engaged with an open side of the case to cover the opening; and an operating member mounted on the periphery of said case and arranged to release the cap from engagement, wherein said operating member includes a peripheral member, which is rotatably supported at two points on an imaginary straight line crossing an axial direction of said case as a rotation center, and an operating force imparting portion formed continuously with the peripheral member, said peripheral member has a closed loop shape enclosing the peripheral surface of said case and includes force apply points for imparting a force in a direction where said cap is released from the engagement, the peripheral member including an upper flat face portion and inclined face portions continuous with the upper flat face portion and located at opposite sides to the operating force imparting portion, said force apply points are respectively located at symmetrical positions away from said rotation center at the opposite side to said operating force imparting portion;

wherein said cap is formed in a shape having an open end and includes a top wall and a peripheral wall continuous with the periphery of the top wall, and when an operating force is imparted to said operating force imparting portion and said peripheral member is rotated and displaced, said force apply points only are brought into contact with end portions at said open end side of said peripheral wall thereby releasing said cap from the engagement.

2. The tubular case according to claim 1, wherein said inclined face portions are formed as a non-contact area which maintains contact only at said force apply points.

3. A tubular case, comprising:

a case for receiving an item, wherein said case has a tubular shape with an opening through which the item is extendible or retractable in a reciprocating manner;

a cap releasably engageable with the case to cover the opening; and an operating member mounted on said case and arranged to release the cap from engagement with the case;

wherein said operating member includes a peripheral member mounted on said case and rotatable about a rotational axis that crosses an axial direction of said case, and an operating force imparting portion formed integrally with the peripheral member for causing the entire peripheral member to rotate about the rotational axis when an operating force is applied to said operating force imparting portion;

said peripheral member has a closed loop shape enclosing a periphery of said case and includes, on an upper face thereof, force applying points for imparting a force on said cap to release said cap from the engagement with the case; and said force applying points and said operating force imparting portion are located on opposite sides of said rotational axis;

wherein said peripheral member further includes, on the upper face thereof, a flat face portion, and inclined face portions extending continuously from the flat face portion in a direction away from the operating force imparting portion;

wherein said force applying points are defined between the flat face portion and the inclined face portions;

wherein said cap includes a top wall defining a closed end of said cap, and a peripheral wall continuous with a periphery of the top wall and defining an open end of said cap;

wherein said peripheral member is rotatable about the rotational axis, in response to an application of the operating force to said operating force imparting portion, to bring said force applying points into contact with end portions of said peripheral wall at the open end of said cap, thereby releasing said cap from the engagement with said case.

4. The tubular case according to claim 3, wherein said peripheral member is contactable with said cap only at said force applying points.

5. The tubular case according to claim 4, wherein said inclined face portions define a non-contact area which is non-contactable with the cap.

* * * * *